United States Patent [19]

Foley

[11] Patent Number: 4,638,397

[45] Date of Patent: Jan. 20, 1987

[54] SELF-BIASED SCOROTRON AND CONTROL THEREFOR

[75] Inventor: Geoffrey M. T. Foley, Fairport, N.Y.

[73] Assignee: Xerox Corporation, Stamford, Conn.

[21] Appl. No.: 685,182

[22] Filed: Dec. 21, 1984

[51] Int. Cl.[4] ..... H01T 19/04

[52] U.S. Cl. ..... 361/212; 361/230; 361/235; 250/325; 250/326

[58] Field of Search ..... 361/212–214, 361/229, 230, 235; 250/325, 326; 323/221, 231, 233; 355/69

[56] References Cited

U.S. PATENT DOCUMENTS

| | | | |
|---|---|---|---|
| 2,777,957 | 1/1957 | Walkup | 250/325 |
| 3,248,642 | 4/1966 | Rothschild | 323/221 |
| 3,335,275 | 8/1967 | King | 250/325 |
| 3,543,140 | 11/1970 | Krausser | 323/231 |
| 3,604,925 | 9/1971 | Snelling | 361/235 X |
| 3,729,649 | 4/1973 | La Chappelle et al. | 250/326 |
| 4,140,962 | 6/1977 | Quinn | 250/326 |
| 4,233,511 | 11/1980 | Harada et al. | 250/325 |
| 4,335,420 | 6/1982 | Mitsuo et al. | 361/230 |
| 4,463,284 | 7/1984 | Tamura et al. | 355/64 X |
| 4,591,713 | 5/1986 | Gundlach et al. | 250/326 |

*Primary Examiner*—L. T. Hix
*Assistant Examiner*—D. Rutledge
*Attorney, Agent, or Firm*—Mark Costello

[57] ABSTRACT

A scorotron and control therefor for charging and/or discharging a charge retentive surface such as a photoreceptor of the type utilized in the process of xerographic printing. The control connects the wire grid of the scorotron to ground via a plurality of zener diodes and a variable resistor. The voltage across the variable resistor is low compared to the total circuit voltage so that variations in the grid current result in small variations in grid voltage. The control provides for compensation for out of tolerance zener diodes as well as for photoreceptor aging manufacturing tolerances and temperature elevation. When the variable resistor is a light dependent resistor a light emitting diode contained in a bridge network also containing a thermistor provides for automatic compensation due to elevation in photoreceptor temperature when such temperature is sensed by the thermistor.

9 Claims, 3 Drawing Figures

SELF-BIASED SCOROTRON AND CONTROL THEREFOR

BACKGROUND OF THE INVENTION

1. Field of the Invention

The invention relates to the art of forming images on a charge retentive surface and more particularly to a method and apparatus for uniformly charging a charge retentive surface and/or discharging the surface.

2. Description of the Prior Art

Pursuant to forming images on a charge retentive surface, it is common to apply a uniform electrostatic charge to the surface of a charge retentive surface, for example, a photoconductive layer. The charge in selected areas is then dissipated by exposing the surface to a light image to form an electrostatic latent image. The latent image is then rendered visible by applying thereto finely divided electrostatically charged developer particles which adhere to the surface by electrostatic attraction. Permanent visible images can be obtained, for example, by using thermoplastic developer particles which are heat fused to a copy substrate such as plain paper.

Charging is conventionally accomplished by exposing the surface of the charge retentive surface to a corona source, the polarity of which is chosen to produce the desired results upon the particular surface being charged. The corona source is commonly provided by one or more fine wires positioned close to the surface. When a high voltage potential is applied to the wire or wires, a corona is generated or discharged and ions are attracted to and deposited on the surface. Superior image reproductions are obtainable only when very uniform electrostatic charges are established on the surface before imaging.

High voltages for generating corona are particularly desirable for producing charge uniformity, but can subject the surface to excessive charge build-up (charge potential), which can cause damage by current leakage. A number of techniques have been employed to limit the charge potential on the photoconductive layer. For example, complex electrical circuitry has been used to limit corona production (an example being disclosed in U.S. Pat. No. 3,335,275 to King).

Another technique employed to limit the charge potential on a surface is the use of a wire grid or screen placed between the corona discharge wire and the surface. This apparatus is commonly referred to as a "scorotron" and is described in U.S. Pat. No. 2,777,957. The grid is maintained at a predetermined potential and serves to terminate further charging of the surface when the surface potential on all portions of the surface corresponds to the grid potential. The grid can be grounded or biased by means of an external voltage source, or it can be self-biased from the corona current by connecting the grid to ground arrangement through current flow restricting devices (an example of the latter being illustrated in U.S. Pat. No. 3,729,649). In U.S. Pat. No. 3,729,649 a control electrode or grid is connected to ground through a zener diode. Such a grid to ground arrangement is also disclosed in U.S. Pat. No. 4,233,511 assigned to Ricoh Company Limited. In such an arrangement, the threshold voltage for conduction in the reverse bias direction determines the voltage value to which the voltage on the control grid is controlled. The potential to which the grid is controlled determines the voltage level to which the charge retentive surface is charged.

Due to inherent manufacturing tolerance variations in devices such as zener diodes, it is not always possible to control the scorotron grid to the exact voltage desired. This problem has been, to a degree, overcome as illustrated in U.S. Pat. No. 4,335,420 by the provision of plural zener diodes and a multi-position switch which serves to connect one or the other of these diodes to the control grid or screen. However, if the desired voltage level for the control grid is not exactly matched by the voltage of one of the zener diodes then this arrangement is not satisfactory. Moreover, this arrangement is not entirely suitable for varying the voltage to which the grid is controlled when this value has to be changed because of a change in voltage level of the surface. As the charge retentive surface ages its charging characteristics change thereby necessitating a change being made to the output of the charging device. Furthermore, charging characteristics of one retentive surface to another vary as a result of manufacturing tolerances necessitating individual adjustment of the charging device for each surface.

Adjusting the self-bias on scorotron grid can be effected by means of a variable resistor interposed between the control grid and ground. However, this arrangement is not suitable for this application where there are current fluctuations due to, for example, line voltage surges. This is because such current variations produce large grid voltage variations. A more serious problem with respect to current variations arises from variations in voltage of the incoming charge receptor which translate into grid current variations in the scrotoron.

In view of the foregoing, it can be seen that a charging device such as a scorotron that is provided with means for compensating for variation in component tolerances as well as photoconductive layer changes while substantially maintaining the grid voltage at a constant level and which does not adversely affect the photoconductive layer is most desirable. This is particularly true in the case of scorotron devices of the type disclosed in U.S. patent application in Ser. No. 567,717, filed Jan. 1, 1984 in the name of Gundlach et al. and assigned to the same assignee as the instant application. In the aforementioned application improved charging of a charge retentive surface is effected by a device that is more closely spaced to the charge retentive surface than prior art devices and wherein the open area in the screen or grid is less than prior art screens. In such a device the grid exerts more powerful control over the final surface potential.

BRIEF DESCRIPTION OF THE INVENTION

Accordingly, I have provided as disclosed herein below in greater detail a scorotron charging device wherein the control grid or screen is connected to ground via a circuit containing impedance elements which provide adjustment of the voltage applied to the control grid over a range which is a fraction of the nominal grid voltage. Such adjustment allows for compensation in the variability in zener diode breakdown voltage due to fabrication tolerances and/or variations in the photoconductive layer charging characteristics.

To this end, I have provided a plurality of series connected zener diodes whose combined breakdown voltage is equal to the voltage to which the grid is to be controlled. A variable resistor is connected across one of the zener diodes and its impedance value is chosen such that the grid voltage can be trimmed over a small voltage range. The nominal grid voltage is largely determined by the zener diodes. Thus, fractional variations in grid current occurring during operation of the device result in grid voltage variations which are corresponding fractions of the small voltage developed across the resistor. These grid voltage variations are therefore necessarily small when the voltage dropped across the resistor is small relative to the total voltage dropped across the circuit. The chosen resistance value of the resistor is intentionally small for this purpose. This contrasts with the case where the grid voltage control is achieved exclusively by a resistive element. There, fractional changes in grid voltage variations can be large and therefore unacceptable.

The invention and its advantages will now be discussed in greater detail in connection with suitable drawings wherein.

DETAILED DESCRIPTION OF THE PREFERRED EMBODIMENT OF THE INVENTION

Figure 1:
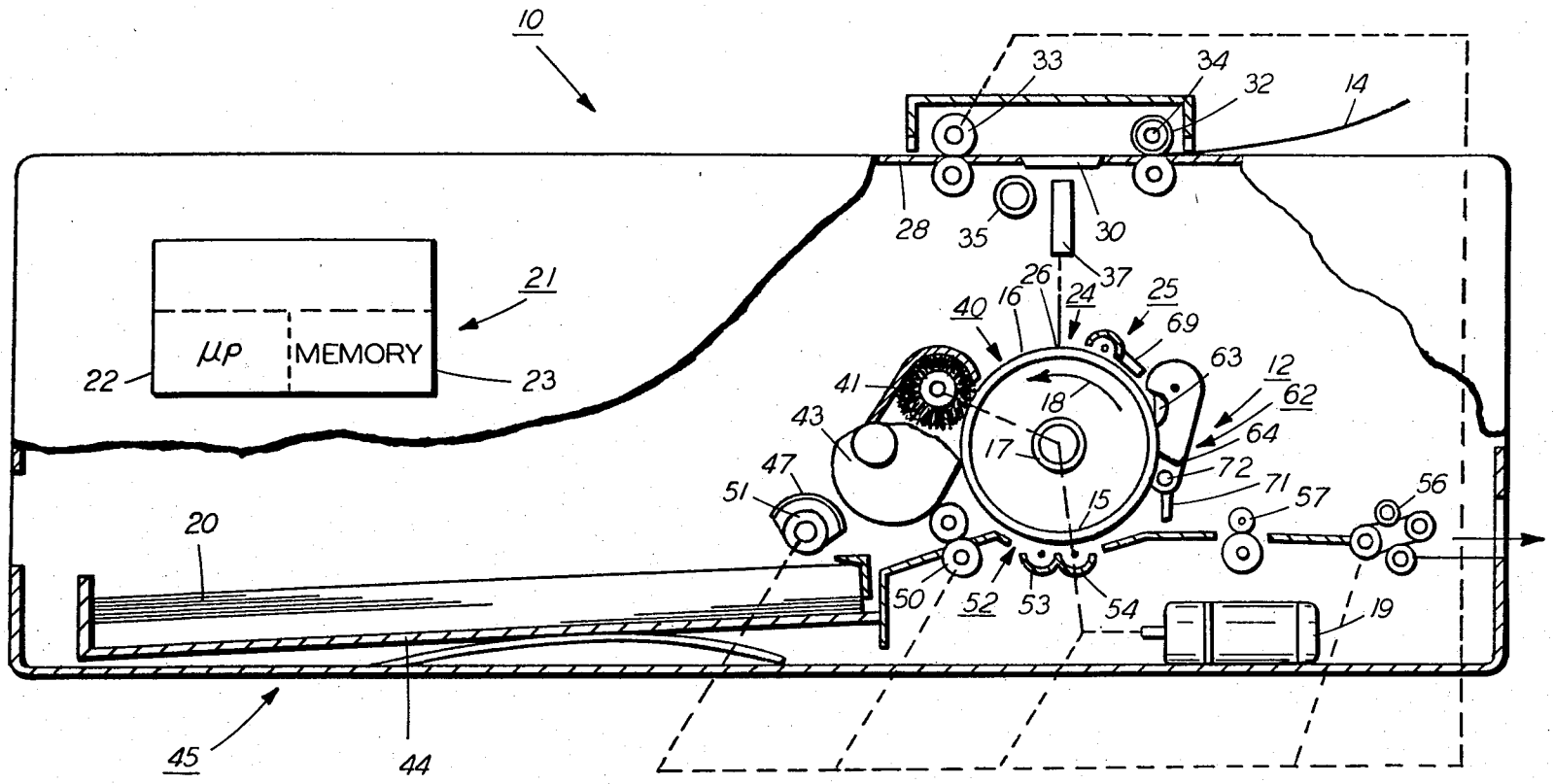
FIG. 1 is an elevational view depicting a xerographic reproduction machine adapted to incorporate the scorotron charging device of the present invention.

Referring to FIG. 1 of the drawings, there is shown by way of example, an automatic xerographic reproduction or printing machine 10 incorporating the charging device of the present invention.

The reproduction machine 10 depicted in FIG. 1 illustrates the various components utilized in machines of this type for producing copies of a document original 14. Although the charging device is particularly well adapted for use in reproduction machine 10, it should become evident from the following description that it is equally well suited for use in a wide variety of other reproduction and printing machine types and systems and it is not necessarily limited in application to the particular embodiment of the embodiments shown herein.

Reproduction machine 10 has an image recording charge retentive surface or photoreceptor 15 in the form of a drum, the outer periphery of which has a suitable photoconductive layer 16. Photoreceptor 15 is suitably journaled for rotation within the machine frame (not shown) as by means of shaft 17. A main drive motor 19 is drivingly coupled to photoreceptor 15, motor 19 rotating photoreceptor 15 in the direction indicated by arrow 18 to bring the photoconductive surface 16 of photoreceptor 15 past a series of xerographic processing stations. A suitable controller 21 with microprocessor 22 and memory 23 is provided for operating in predetermined timed relationship the various components that comprise machine 10 to reproduce the document original 14 upon a sheet of final support material such as copy sheet 20. As will be understood by those familiar with the art, memory 23 may comprise suitable read only memory (ROM), random access memory (RAM), and/or non-volatile memory (NVM), memory 23 serving to store the various operating parameters for reproduction machine 10 an the copy run information programmed by the machine user or operator.

Initially, the photoconductive surface 16 of photoreceptor 15 is uniformly charged by a suitable charging device such as scorotron 25 at charging station 24. The uniformly charged photoconductive surface 16 is exposed at exposure station 26 to create a latent electrostatic image of the document original 14 on photoreceptor 15. For this purpose, a suitable supporting surface or platen 28 for document original 14 is provided having a scan aperture or slit 30 therethrough. A suitable document transport, depicted herein as inlet and outlet constant velocity roll pairs 32, 33 is provided for transporting the document original past scan slit 30. Roll pairs 32, 33 are drivingly coupled to main drive motor 19, roll pair 32 being coupled through an electromagnetically operated clutch 34. A suitable document sensor 31 is provided at the inlet to platen 28 for sensing the insertion of a document original 14 to be copied and initiating operation of the reproduction machine 10.

A lamp 35, which is disposed below platen 28, serves to illuminate scan slit 30 and the line-like portion of the document original 14 thereover. A suitable fiber optic type lens array 37, which may, for example, comprise an array of gradient index fiber elements, is provided to optically transmit the image ray reflected from the line-like portion of the document original being scanned to the photoconductive surface 16 of photoreceptor 15 at exposure station 26.

Following exposure, the latent image of the photoconductive surface 16 of photoreceptor 15 is developed at a development station 40. There, a suitable developer such as magnetic brush roll 41, which is drivingly coupled to main drive motor 19, brings a suitable developer mix in developer housing 43 into developing relation with the latent image to develop the image and render the same visible.

Copy sheets 20 are supported in stack-like fashion on base 44 of copy sheet supply tray 45. Suitable biasing means are provided to raise base 44 of tray 45 and bring the topmost copy sheet 20 in the stack of sheets 47 into operative relationship with segmented feed rolls 49. Feed rolls 49 are driven by main drive motor 19 through an electromagnetically operated clutch 51. Rolls 49 serve upon actuation of clutch 51 to feed the topmost copy sheet forward into the image on the photoconductive surface 16 of photoreceptor 15. Registration roll pair 50 advance the copy sheet to transfer station 52. There, suitable transfer/detack means such as transfer/detack corotrons 53, 54 bring the copy sheet into transfer relation with the developed image on photoconductive surface 16 and separate the copy sheet therefrom for fixing and discharge as a finished copy.

Following transfer station 52, the image bearing copy sheet is transported to fuser 57 where the image is permanently fixed to the image bearing copy sheet. Following fusing, the finished copy is transported by roll pair 56 to a suitable receptacle such as an output tray (not shown). Registration roll pair 50 and transport roll pair 5 are driven by main drive motor 19 through suitable driving means such as belts and pulleys.

Following transfer, residual developer remaining on the photoconductive surface 16 of photoreceptor 15 is removed at cleaning station 62 by means of cleaning blade 63. Developer removed by blade 63 is deposited into a suitable collector 64 for removal.

While a drum type photoreceptor is shown and described herein, it will be understood that other photoreceptor types may be employed such as belt, web, etc.

To permit effective and controlled charging of the photoconductive surface 16 by scorotron 25 to a predetermined level necessitates that any residual charges on the photoconductive surface 16 or trapped in the photoreceptor be removed prior to charging. An erase device 69 is provided for this purpose. This function is not necessary under all circumstances.

At the cleaning station 62, the cleaning blade 63 is supported in contact with the photoreceptor 15 such that residual toner is chiselled therefrom.

The toner and debris that are removed from the photoreceptor 15 fall into the collector 64 and are transported by means of an auger 72 disposed in the bottom of the collector 64. It is moved toward the back of the machine where it falls through an opening in the bottom of the collector 64. The residual toner and debris fall downwardly via conduit 71 into a receptacle (not shown) which serves to store the residual toner until the receptacle is full after which it is removed form the machine.

Figure 2:
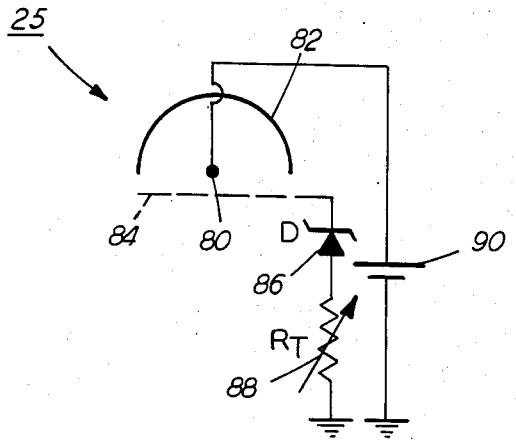
FIG. 2 is a schematic view of a scorotron and control circuit therefor.
Figure 3:
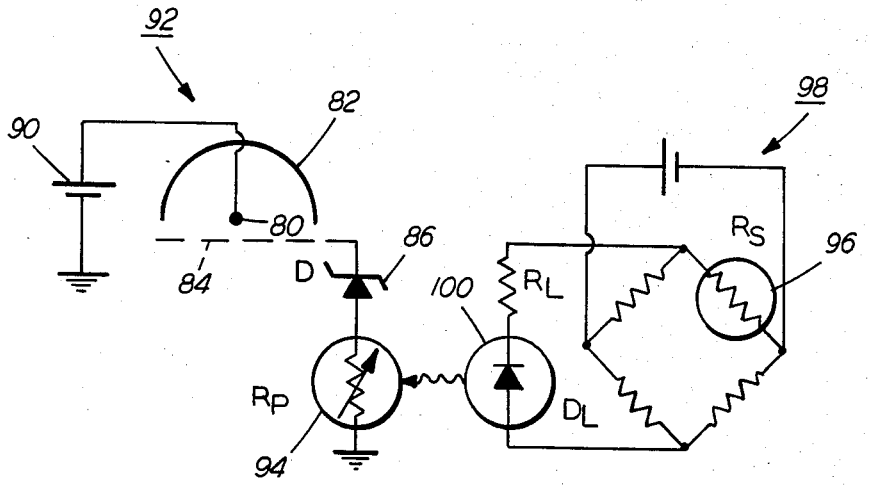
FIG. 3 is schematic view of the scorotron and modified control circuit therefor.

The inventive aspects of our invention will become more readily apparent from a detailed discussion of FIGS. 2 and 3. The scorotron 25 comprises, as viewed in FIGS. 2 and 3 in a conventional corona electrode 80 in the form of a thin wire and a conductive shield 82. A wire grid or screen 84 forming part of the scorotron device is connected to ground via a plurality of zener diodes 86 and a variable resistor 88. The zener diodes and the variable resistor form a self-biasing control for maintaining the screen at a predetermined voltage level in accordance with the invention. A power source 90 is provided for applying a suitable voltage to the thin wire 80.

A modified form of the scorotron device illustrated in FIG. 2 is depicted in FIG. 3. As shown therein, a scorotron 92 comprises an electrode 80, conductive shield 82, wire grid 84 and a power source 90. It also comprises a plurality of zener diodes 86 and a light dependent resistor 94. The zener diodes 86 and resistor 94 form a self-biasing control for maintaining the voltage across the wire screen at a predetermined voltage.

Reference character 96 designates a temperature sensitive device such as a thermistor. The thermistor is physically located in or near the photoreceptor cavity (i.e. the area in which the photoreceptor is situated). The thermistor forms a part of a bridge network generally indicated by the reference character 98. A detector 100 in the form of a light emitting diode (LED) serves as a detector the brightness of which varies in response to a bridge imbalance due to a change in impedance of the thermistor 96, this impedance change being caused by virtue of a temperature change in the photoreceptor cavity which determines also the temperature of photoreceptor 15. The LED is positioned adjacent the light dependent resistor 94 and its resistance is varied in response to a change in illumination from the LED. Thus, the loss of surface potential (i.e increased dark decay) of the photoreceptor 15 which is a general characteristic of operation at an elevated temperature is automatically compensated for by the bridge circuit and light dependent resistor. Dark decay is defined as the loss of photoreceptor potential during the time period that it travels from the charging station to the development station. Accordingly, the bridge balance is arranged such that the rate of dark decay is increased due to an elevated photoreceptor temperature, the LED intensity decreases thereby increasing the impedance of the light dependent resistor which allows for the scorotron to operate at a higher charging level in order to compensate for the dark decay.

In operation of the embodiment of FIG. 3, four zener diodes were connected in series with the variable resistor 86 in order to control the voltage level of the wire grid to 800 volts with 5500 volts d.c. applied to the coronode wire 84. The breakdown voltage of each zener diode was approximately 180 volts. The resistor had a rating of 1 megohm which allowed, with a grid current of 100 microamperes an adjustment of the circuit in the order 0–100 volts. Thus, it was possible to attain the desired 800 volt level on the control grid. At that value of the variable resistor, it was also possible to compensate for a change in photoreceptor charging characteristics due to aging or manufacturing tolerances. By manual adjustment of the variable resistor, it was possible to adjust the potential on the grid. From a consideration of the embodiment illustrated in FIG. 3, it is apparent that automatic compensation for cycle down (i.e. dark decay) due to an elevated photoreceptor temperature is obtained. The resistive bridge is balanced at the upper end of the operating temperature range. Thus, when the photoreceptor temperature decreases, such decrease is sensed by the thermistor 96 creating an imbalance in the bridge network 98 thereby causing the LED to shine brighter which, in turn, causes the resistance of light dependent resistor 94 to decrease thereby causing a decrease in the potential of the wire grid 84.

It can now be appreciated that there has been disclosed, a scorotron discharge device and control therefor which can compensate for out of tolerance zener diodes. Moreover, compensation is provided for photoreceptor aging and manufacturing tolerances as well as increased photoreceptor temperature. In the case of the latter, compensation is effected automatically.

I claim:

1. A corona discharge device for use with a charge retentive surface, said device comprising:

at least one electrode;

a conductive shield spaced from said electrode;

means for applying a voltage to said electrode;

a wire grid supported adjacent said electrode, said electrode being disposed intermediate said conductive shield and said wire grid; and self-biasing means including constant voltage impedance means and manually settable variable impedance means connecting said wire grid to ground, said manually settable variable impedance means serving to effect adjustment of said self-biasing means in accordance with the nominal impedance value of said constant voltage impedance means.

2. A device according to claim 1 wherein said constant voltage impedance means comprises a plurality of zener diodes.

3. A device according to claim 2 wherein said variable impedance means comprises a variable resistor connected in series with said zener diodes.

4. A corona discharge device for use with a charge retentive surface, said device comprising:

at least one electrode;

a conductive shield spaced from said electrode;

means for applying a voltage to said electrode;

a wire grid supported adjacent said electrode, said electrode being disposed intermediate said conductive shield and said wire grid;

self biasing means including constant voltage impedance means and variable impedance means connecting said wire grid to ground, said variable impedance serving to effect adjustment of said self-biasing means in accordance with the nominal impedance value of said constant voltage impedance means; and said variable impedance means including a light dependent resistor and a light emitting member optically coupled with said light dependent resistor and adapted to change intensity in response to a change in temperature of said charge retentive surface, whereby said variable impedance adjusts in response to temperature variations of the charge retentive surface.

5. A device according to claim 4 further including a temperature responsive member cooperating with said light emitting member for effecting said change in intensity.

6. A device according to claim 5 wherein said light emitting member comprises a light emitting diode.

7. Apparatus for forming toner images on a charge retentive surface including a corona discharge device comprising:

at least one electrode;

a conductive shield spaced from said electrode;

means for applying a voltage to said electrode;

a wire grid supported adjacent said electrode, said electrode being disposed intermediate said conductive shield and said wire grid; and self-biasing means including constant voltage impedance means and manually settable variable impedance means connecting said wire grid to ground, said manually settable variable impedance means serving to effect adjustment of said self-biasing means in accordance with the nominal impedance value of said constant voltage impedance means.

8. Apparatus according to claim 7 wherein said constant voltage impedance means comprises a plurality of zener diodes.

9. Apparatus according to claim 8 wherein said variable impedance means comprises variable resistor connected in series with said zener diodes.

* * * * *